US008100669B2

(12) United States Patent
Lu

(10) Patent No.: US 8,100,669 B2
(45) Date of Patent: Jan. 24, 2012

(54) MICRO-PUMP AND MICRO-PUMP SYSTEM

(75) Inventor: Chun-Fu Lu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 322 days.

(21) Appl. No.: 12/557,501

(22) Filed: Sep. 10, 2009

(65) Prior Publication Data

US 2010/0001096 A1 Jan. 7, 2010

Related U.S. Application Data

(62) Division of application No. 11/467,171, filed on Aug. 25, 2006.

(30) Foreign Application Priority Data

Jun. 20, 2006 (TW) ..... 95122005 A

(51) Int. Cl.

| | |
|---|---|
| ***F04F 1/06*** | (2006.01) |
| ***F04F 3/00*** | (2006.01) |
| ***B05B 1/08*** | (2006.01) |
| ***B05B 3/04*** | (2006.01) |

(52) U.S. Cl. ..... 417/121; 239/102.2

(58) Field of Classification Search ..... 239/102.1, 239/102.2, 562; 417/65, 118, 121, 395, 412, 417/413.1, 413.2, 555.1; 604/131, 132–133, 604/140–147, 890.1–892.1

See application file for complete search history.

(56) References Cited

U.S. PATENT DOCUMENTS

| | | | | |
|---|---|---|---|---|
| 2,658,301 | A * | 11/1953 | Merrill | 222/631 |
| 5,908,158 | A * | 6/1999 | Cheiman | 239/102.2 |
| 5,922,247 | A * | 7/1999 | Shoham et al. | 261/78.2 |
| 6,290,331 | B1 * | 9/2001 | Agarwal et al. | 347/47 |
| 2004/0174411 | A1 * | 9/2004 | Sumiya et al. | 347/47 |
| 2005/0035216 | A1 * | 2/2005 | Miller et al. | 239/302 |
| 2006/0201500 | A1 * | 9/2006 | Von Hollen et al. | 128/203.12 |
| 2007/0040870 | A1 * | 2/2007 | Lu et al. | 347/68 |
| 2007/0120898 | A1 * | 5/2007 | Lu et al. | 347/69 |

* cited by examiner

*Primary Examiner* — Devon C Kramer
*Assistant Examiner* — Bryan Lettman
(74) *Attorney, Agent, or Firm* — Jianq Chyun IP Office

(57) ABSTRACT

A micro-pump for atomizing and including a main-housing, a nozzle plate, at least an actuator, and a liquid transport pipe is provided. The main-housing has a liquid inlet, a liquid outlet, an air inlet, and a micro-droplet outlet. The nozzle plate is assembled to the main-housing and has at least one nozzle. The nozzle plate divides the interior of the main-housing into a first chamber and a second chamber. The nozzle and the liquid inlet are connected with the first chamber. The air inlet, the liquid outlet, and the micro-droplet outlet are connected with the second chamber. The actuator is disposed on at least one of the main-housing or the nozzle plate. The actuator drives the nozzle plate, so that liquid is filled into the first chamber and sprayed out through the nozzle into the second chamber. The liquid transport pipe connects the liquid inlet and the liquid outlet.

22 Claims, 10 Drawing Sheets

600a

600b

600c

MICRO-PUMP AND MICRO-PUMP SYSTEM

CROSS-REFERENCE TO RELATED APPLICATION

This is a divisional application of and claims the priority benefit of patent application Ser. No. 11/467,171, filed on Aug. 25, 2006, which claims the priority benefit of Taiwan application serial no. 95122005, filed on Jun. 20, 2006. The entirety of each of the above-mentioned patent applications is hereby incorporated by reference herein and made a part of this specification.

BACKGROUND OF THE INVENTION

1. Technical Field

The present disclosure relates to a pump and a pump system. More particularly, the present disclosure relates to a micro-pump and a micro-pump system.

2. Background

Micro-droplets are widely used in cooling, pharmaceutical field, and surface treatment. As micro-droplets have a relatively high surface area/mass ratio, the reaction efficiency of the system can be greatly improved.

U.S. Pat. No. 6,205,999 discloses a device, which can generate a solvent by dissolving a dry chemical substance into a solution. Then, a right amount of the solvent is dropped onto the nozzle plate, and the nozzle plate is driven by a piezoelectric element to spray out the solvent. However, the device has complicated components and large volume.

U.S. Pat. No. 6,010,316 discloses an acoustic micro-pump, which converts electric energy into sound energy and makes use of the pressure gradient generated by the sound energy to drive the transportation of liquid. However, the energy can only be used to drive the transportation of liquid after several conversions, thus resulting in a very low efficiency.

In view of the increasing application of micro-droplets and micro-fluid transportation in various fields, how to transport micro-fluid, atomize liquid under normal pressure and normal temperature, and meanwhile to meet the requirements of lower power consumption without destroying the fluid property has become a subject to be solved urgently.

SUMMARY

The present disclosure provides exemplary embodiments of micro-pump, which is applicable to transporting micro-fluid, atomizing liquid, and meanwhile meeting the requirements of low power consumption without destroying the fluid property.

The present disclosure provides an exemplary embodiment of a micro-pump system operating under normal pressure and normal temperature, which is applicable to transporting micro-fluid, atomizing liquid, and meanwhile meeting the requirements of low power consumption without destroying the fluid property.

An exemplary embodiment of a micro-pump used for atomizing liquid is further provided. The micro-pump comprises a main-housing, a nozzle plate, at least an actuator, and a liquid transport pipe. The main-housing has a liquid inlet, a liquid outlet, an air inlet, and a micro-droplet outlet. The nozzle plate is assembled to the main-housing and has at least one nozzle. The nozzle plate divides the interior of the main-housing into a first chamber and a second chamber. The nozzle and the liquid inlet are connected with the first chamber. The air inlet, the liquid outlet, and the micro-droplet outlet are connected with the second chamber. The actuator is disposed on at least one of the main-housing or the nozzle plate. The actuator drives the nozzle plate, so that liquid is filled into the first chamber and sprayed out through the nozzle into the second chamber. The liquid transport pipe connects the liquid inlet and the liquid outlet.

An exemplary embodiment of a micro-pump system is further provided. The system comprises a plurality of micro-pumps and at least one micro-droplet transport pipe. The micro-pumps are used to atomize liquid. Each of the micro-pumps comprises a main-housing, a nozzle plate, at least an actuator, and a liquid transport pipe. The main-housing has a liquid inlet, a liquid outlet, an air inlet, and a micro-droplet outlet. The nozzle plate is assembled to the main-housing and has at least one nozzle. The nozzle plate divides the interior of the main-housing into a first chamber and a second chamber. The nozzle and the liquid inlet are connected with the first chamber. The air inlet, the liquid outlet, and the micro-droplet outlet are connected with the second chamber. The actuator is disposed on at least one of the main-housing or the nozzle plate. The actuator drives the nozzle plate, so that liquid is filled into the first chamber and sprayed out through the nozzle into the second chamber. The liquid transport pipe connects the liquid inlet and the liquid outlet. The two ends of the micro-droplet transport pipe are respectively connected to the air inlet of one of the micro-pumps and the micro-droplet outlet of another micro-pump.

In view of the above, the micro-pump and micro-pump system of the disclosed embodiments can transport micro-fluid under normal pressure and normal temperature and atomize liquid.

Exemplary embodiments of the present invention accompanied with figures are described in detail below.

DESCRIPTION OF EMBODIMENTS

Figure 1:
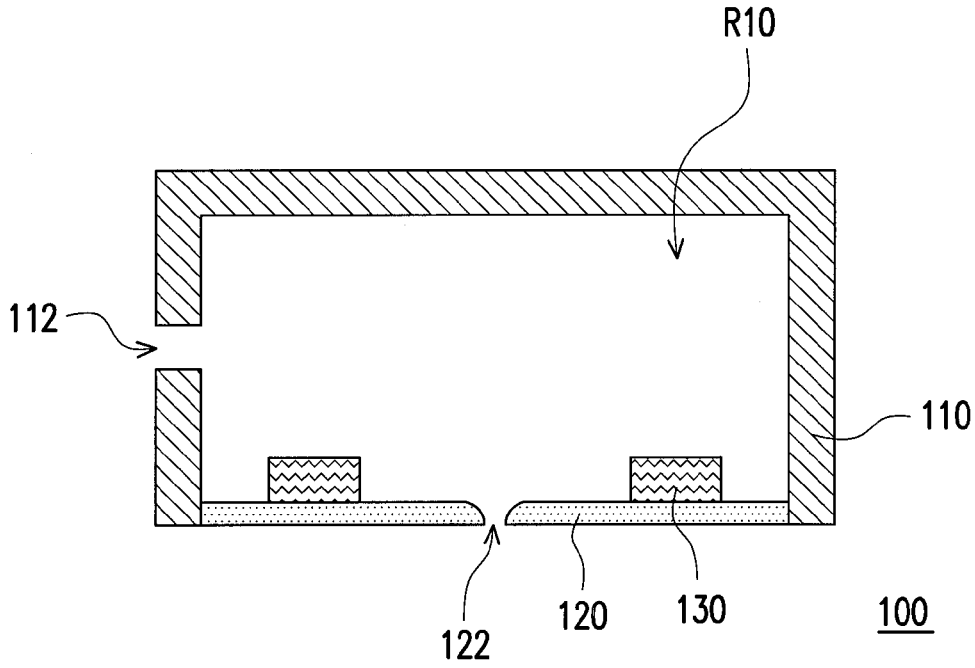
FIG. 1 is a schematic sectional view of the micro-pump system according to an embodiment.
Figure 2A:
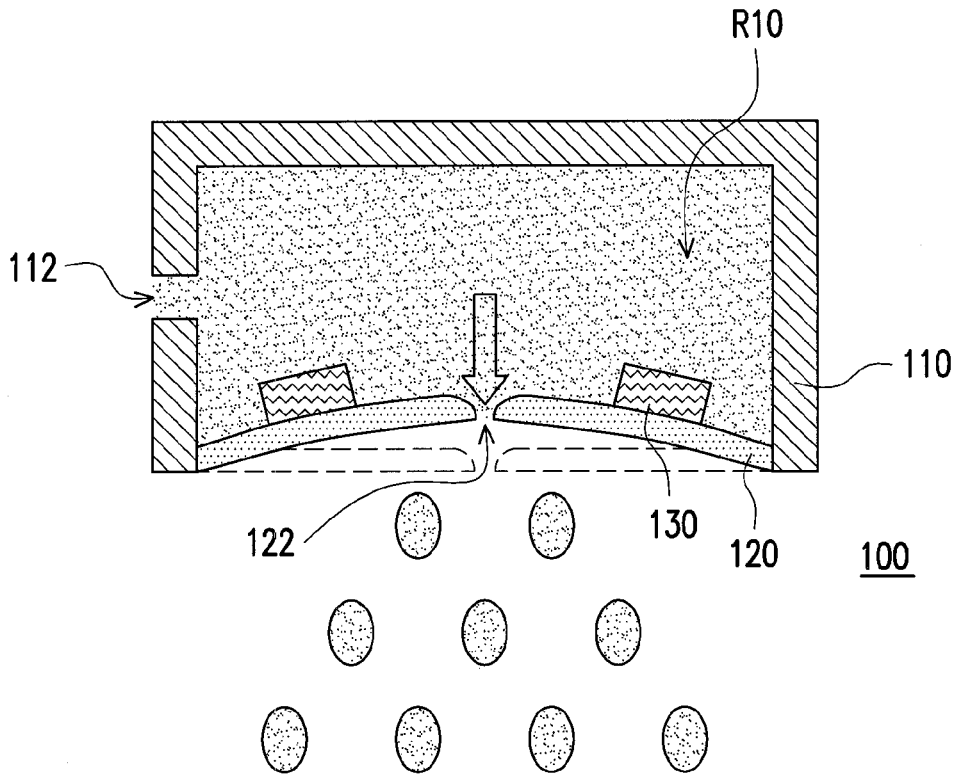
FIG. 2A is a schematic sectional view of the micro-pump in FIG. 1 when atomizing liquid.
Figure 2B:
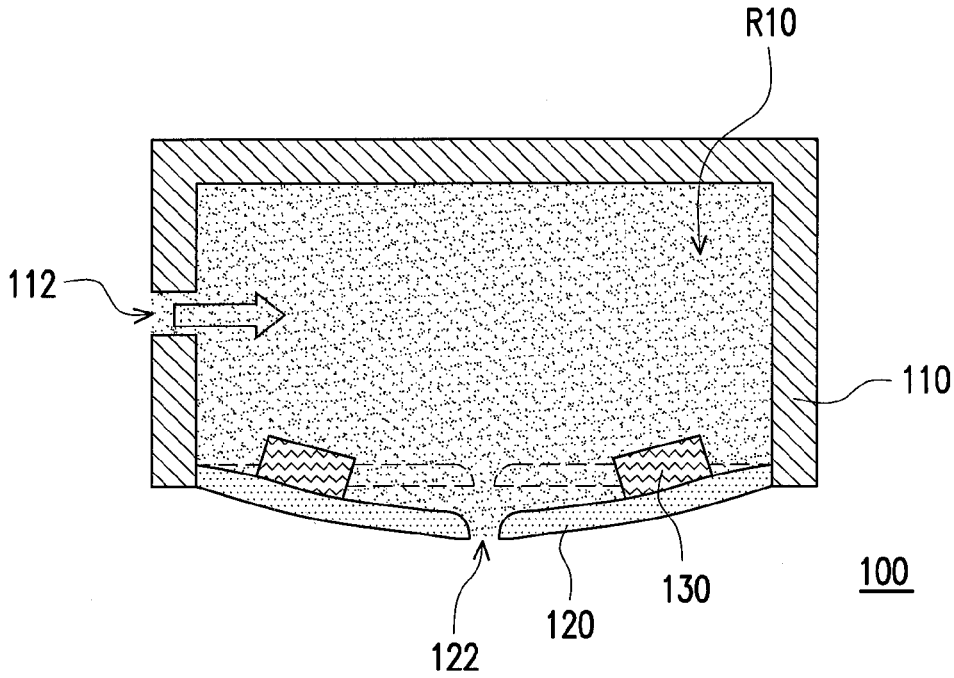
FIG. 2B is a schematic sectional view of the micro-pump in FIG. 1 when complementing liquid.

FIG. 1 is a schematic sectional view of the micro-pump according to an embodiment. FIG. 2A is a schematic sectional view of the micro-pump in FIG. 1 when atomizing liquid. FIG. 2B is a schematic sectional view of the micro-pump in FIG. 1 when complementing liquid.

Referring to FIG. 1, a micro-pump 100 of the present embodiment is used to atomize liquid. The micro-pump 100 comprises a main-housing 110, a nozzle plate 120, and at least an actuator 130. The main-housing 110 has a liquid inlet 112 to fill in the liquid. The nozzle plate 120 is assembled to the main-housing 110 and has at least one nozzle 122. In the present embodiment, only one nozzle 122 is taken as an example, and the nozzle plate 120 can also have a plurality of nozzles 122. A first chamber R10 is formed between the nozzle plate 120 and the main-housing 110. The nozzle 122 and the liquid inlet 112 are connected with the first chamber R10. The actuator 130 can be disposed on either the main-housing 110 or the nozzle plate 120. The actuator 130 can also be disposed on the main-housing 110 and the nozzle plate 120. In the present embodiment, the actuator 130 is, for example, disposed on the nozzle plate 120. In addition, the actuator 130 can be disposed inside or outside the first chamber R10. In the present embodiment, the actuator 130 is disposed inside the first chamber R10.

The operating principle of the micro-pump 100 in the present embodiment is illustrated below with reference to FIGS. 2A and 2B. First, a liquid 50 is filled into the first chamber R10. Then, the actuator 130 starts operating. The actuator 130 of the present embodiment is, for example, a piezoelectric element or an electrostrictive element. When an electric signal is applied to the actuator 130, the actuator 130 vibrates and the electric signal has, for example, a resonant region frequency. Therefore, the nozzle plate 120 is driven by resonance due to the operation of the actuator 130. When the nozzle plate 120 vibrates quickly under the drive of the actuator 130, a sufficient momentum is generated. When the nozzle plate 120 vibrates and is deformed toward the interior of the first chamber R10, the liquid 50 is pressed. When the sufficient momentum can overcome the capillary force, the micro-droplets are forced to be sprayed out of the nozzle 122. When the nozzle plate 120 vibrates and is deformed toward the exterior of the first chamber R10 under the drive of the actuator 130, the nozzle 122 is blocked under the capillary force of the liquid 50. As the amount of the liquid 50 is reduced, the first chamber R10 with a fixed volume assumes a negative pressure state, and the complementary liquid is immediately sucked into the first chamber R10 through the liquid inlet 112. Moreover, the aperture of the nozzle 122 could be not larger than 80 μm.

In view of the above, the micro-pump 100 of the present embodiment is used to transport micro-fluid and atomize liquid without using rotation elements of the conventional pump, and thus the wear and tear of the parts can be prevented. The micro-pump 100 also has the advantages of simple components, small volume, and low power consumption since the micro-pump can operate without several energy conversions. In addition, no extra high-pressure pump is needed, which not only saves cost and reduces volume, but also avoids the changes of the property of the sensitive medicine when applied to the pharmaceutical field.

Figure 3A:
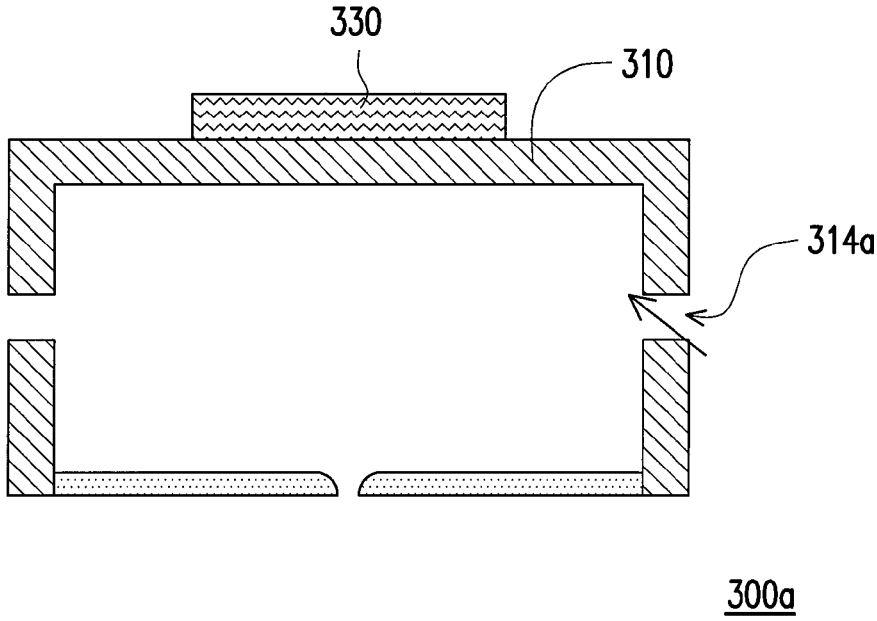
FIGS. 3A and 3B are schematic sectional views of the micro-pump according to another two embodiments.
Figure 3B:
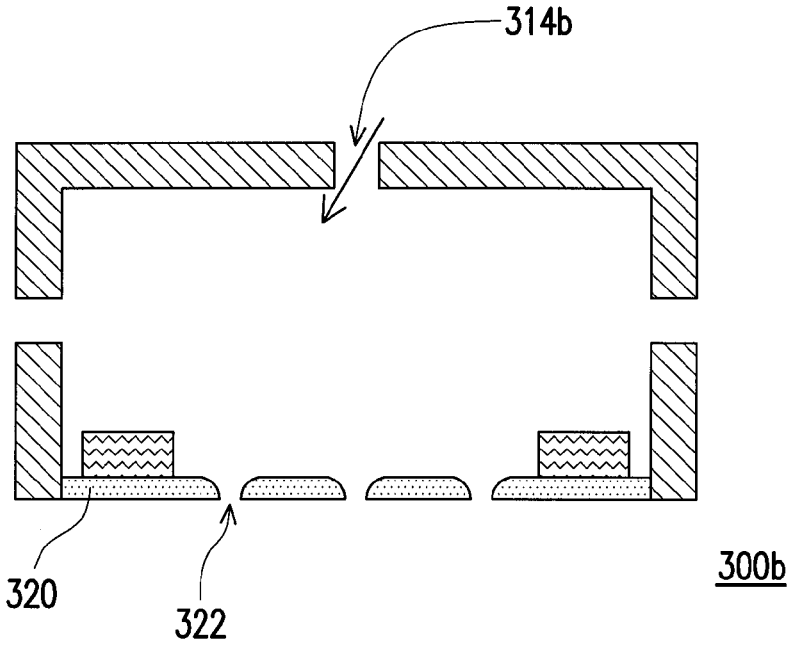

FIGS. 3A and 3B are schematic sectional views of the micro-pump according to another two embodiments. Referring to FIG. 3A, a micro-pump 300*a* of the present embodiment is similar to the micro-pump 100 in FIG. 1, and the difference is that a main-housing 310 of the micro-pump 300*a* further has a one-way exhaust structure 314*a* to exhaust air from a first chamber R30. And the liquid cannot pass through the one-way exhaust structure 314*a*, such that the air inside the first chamber R30 is exhausted when the liquid is filled in the first chamber R30. Moreover, in the embodiment of FIG. 3A, an actuator 330 is, for example, disposed on the main-housing 310 and outside the first chamber R30. However, the actuator 330 can also be disposed on the main-housing 310 and inside the first-chamber R30. Referring to FIG. 3B, a micro-pump 300*b* of the present embodiment is similar to the micro-pump 300*a* in FIG. 3A, and the difference lies in that the position of a one-way exhaust structure 314*b* of the micro-pump 300*b* has been changed. Definitely, the position of the one-way exhaust structure 314*b* can be changed as required. In addition, a nozzle plate 320 of the micro-pump 300*b* has a plurality of nozzles 322.

The nozzle plate used in the micro-pump is further illustrated below with reference to the drawings, but is not limited to this.

Figure 4A:
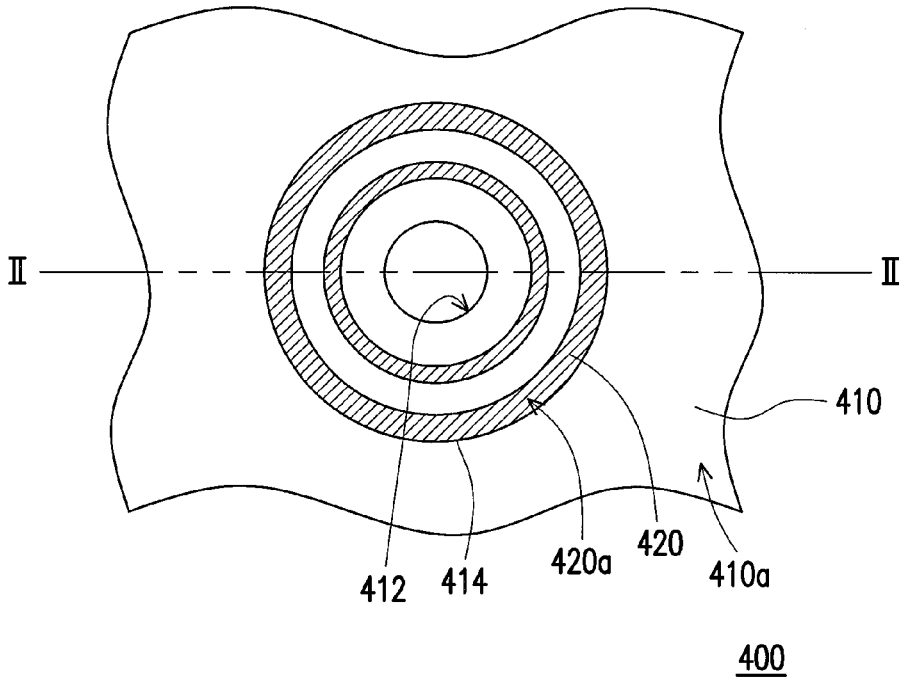
FIG. 4A is a partial top view of the nozzle plate of the micro-pump according to an embodiment.
Figure 4B:
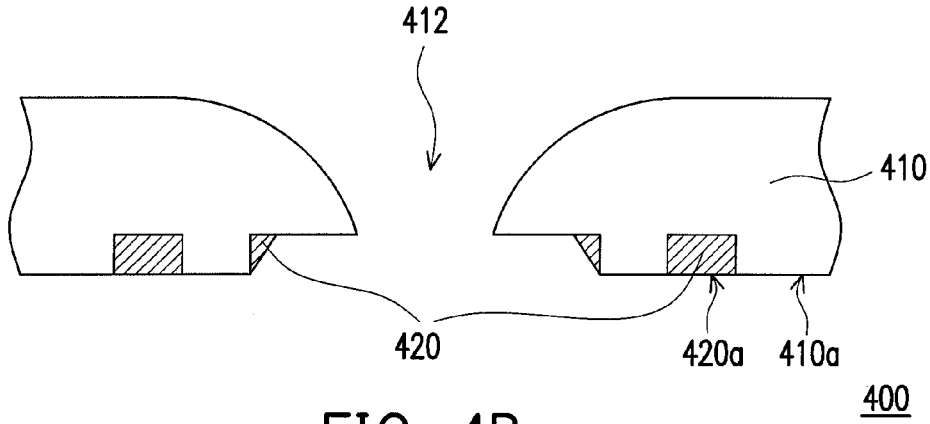
FIG. 4B is a sectional view of FIG. 4A along the line II-II.

FIG. 4A is a partial top view of the nozzle plate of the micro-pump according to an embodiment. FIG. 4B is a sectional view along the line II-II in FIG. 4A. Referring to FIGS. 4A and 4B, a nozzle plate 400 of the present embodiment comprises a nozzle layer 410. The nozzle layer 410 has at least one nozzle 412 penetrating the nozzle layer 410. In order to prevent the residual liquid on a surface 410*a* near the nozzle 412 of the nozzle layer 410 from freely flowing to other areas on the surface 410*a* of the nozzle layer 410, the nozzle layer 410 further has a trench 414 which is disposed on the surface 410*a* thereof surrounding the nozzle 412, and is spaced away from the nozzle 412 for a distance. As such, the liquid is prevented from gathering around the nozzle 412, and thus the liquid can be successfully atomized.

Furthermore, the nozzle plate 400 may further comprise a filling material 420 filled in the trench 414, wherein the wetting angle of a surface 420*a* of the filling material 420 is set to be different from that of the surface 410*a* of the nozzle layer 410. When the material of the nozzle layer 410 is a wettable material (for example, Ni, Si, or materials containing soap base) and the material of the filling material 420 is an anti-wetting material (for example, CF4) relative to the above wettable material, the wetting angle of the surface 420*a* of the filling material 420 is larger than that of the surface 410*a* of the nozzle layer 410. On the contrary, when the material of the nozzle layer 410 is an anti-wetting material (for example, polyimide) and the material of the filling material 420 is a wettable material (for example, Ni or materials containing soap base) relative to the above anti-wetting material, the wetting angle of the surface 420*a* of the filling material 420 is smaller than that of the surface 410*a* of the nozzle layer 410.

No matter what the materials are, the materials are set to form a liquid gathering area on the surface 410*a* around the nozzle 412 of the nozzle layer 410. Therefore, the residual liquid on the surface 410*a* near the nozzle 412 of the nozzle layer 410 does not flow freely to other areas on the surface 410*a* of the nozzle layer 410, thus preventing the gathering of the droplets.

It should be noted that the quantity of the trench 414 around the single nozzle 412 in the present embodiment is, for example, two, but can also be one or more. Further, the nozzle 412 is, for example, a tapered hole or a hole of other appropriate forms, wherein the tapered nozzle hole 412 makes liquid transported only in single direction.

Figure 5A:
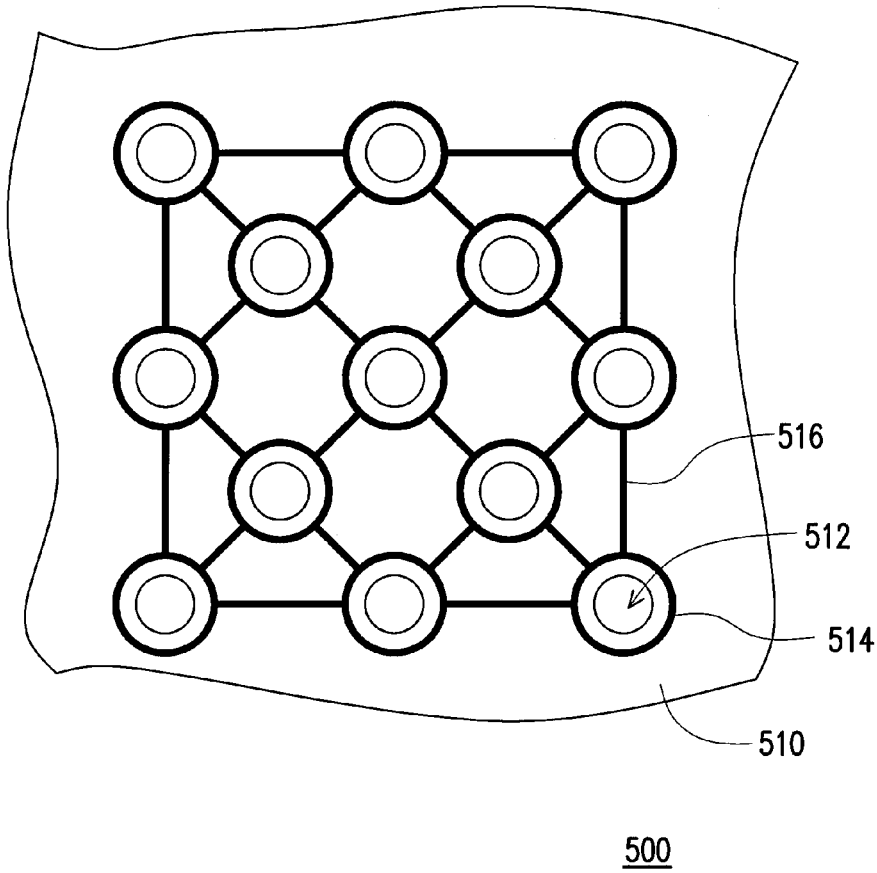
FIG. 5A is partial top view of the nozzle plate of the micro-pump according to another one embodiments.
Figure 5B:
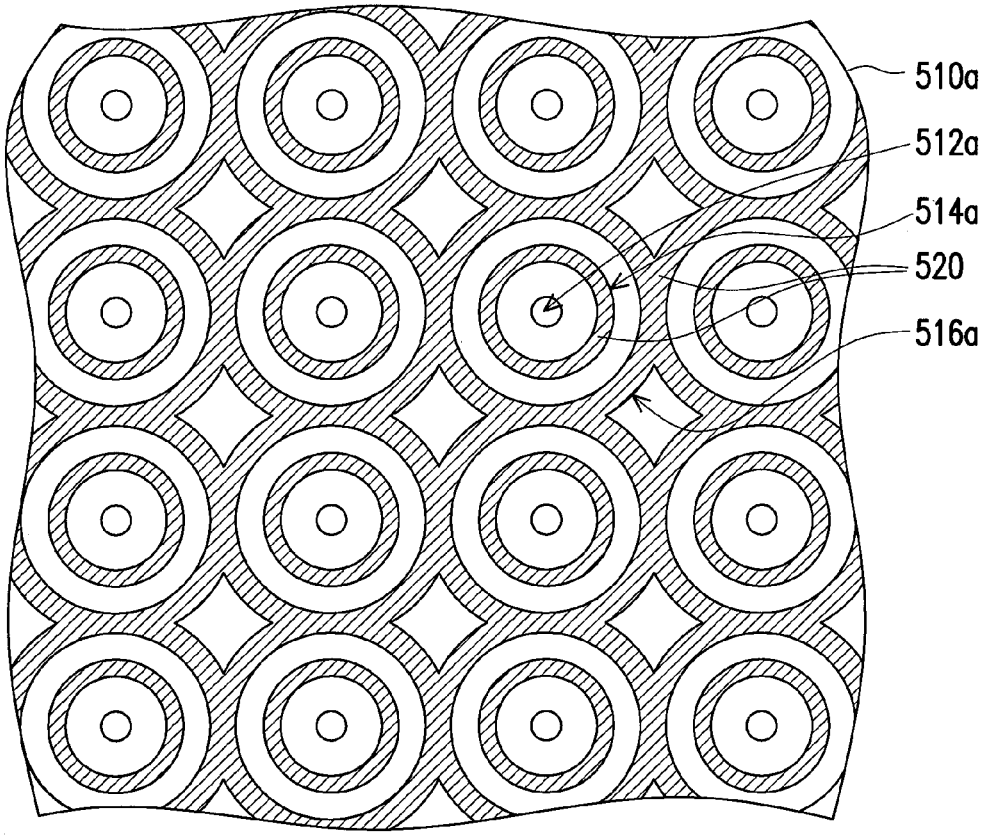
FIG. 5B is partial top view of the nozzle plate in FIG. 4B with modification.

FIG. 5A is partial top view of the nozzle plate of the micro-pump according to another one embodiments. Referring to FIG. 5A, a nozzle layer 510 of a nozzle plate 500 in the present embodiment has a plurality of nozzles 512, a plurality of trenches 514, and at least one connecting trench 516, wherein the quantity of the connecting trench 516 is more than one herein. The plurality of nozzles 512 are arranged in arrays, each of the trenches 514 respectively surrounds one nozzle 512, and the connecting trenches 516 connect the trenches 514. FIG. 5B is partial top view of the nozzle plate in FIG. 4B with modification. Referring to FIG. 5B, a nozzle layer 510*a* of a nozzle plate 500*a* in the present embodiment has a plurality of nozzles 512*a*, a plurality of first trenches 514*a*, and a plurality of second trenches 516*a*. The nozzles 512*a* are arranged in arrays. Each of the first trenches 514*a* and the second trenches 516*a* respectively surround one nozzle 512*a*, and the adjacent second trenches 516*a* connect to each other. The filling material 520 is filled in the partial first trenches 514*a* and the full second trenches 516*a*.

Figure 6A:
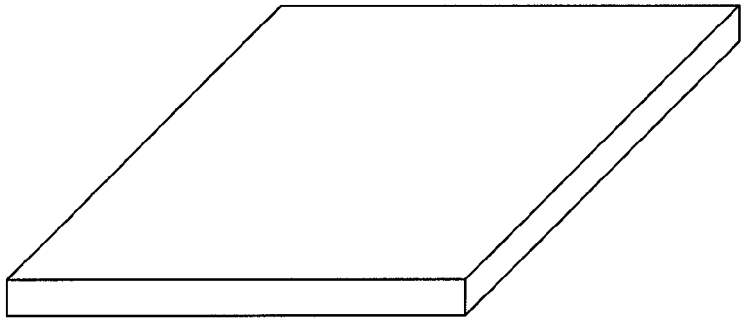
FIGS. 6A~6C are schematic views of the actuator used in the micro-pump according to three embodiments.
Figure 6B:
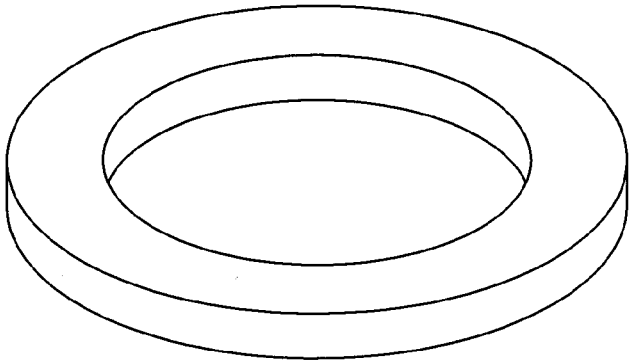
Figure 6C:
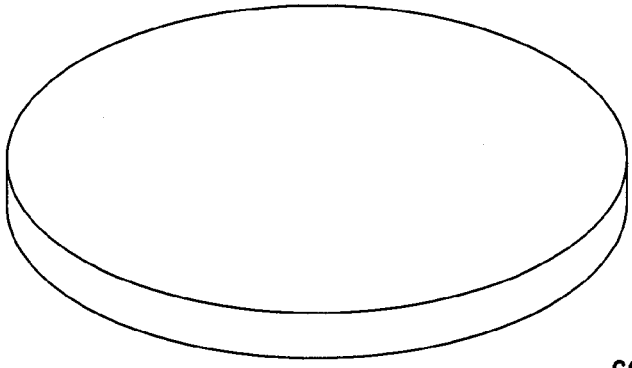

The profile of the actuator used in the micro-pump is further illustrated below with reference to the drawings, but is not limited to this. FIGS. 6A~6C are schematic views of the actuator used in the micro-pump according to three embodiments. The profile of the actuator used in the micro-pump can be in the form of a rectangular sheet (600*a* in FIG. 6A), round sheet (600*b* in FIG. 6B), ring sheet (600*c* in FIG. 6C), or other appropriate profiles.

Figure 7:
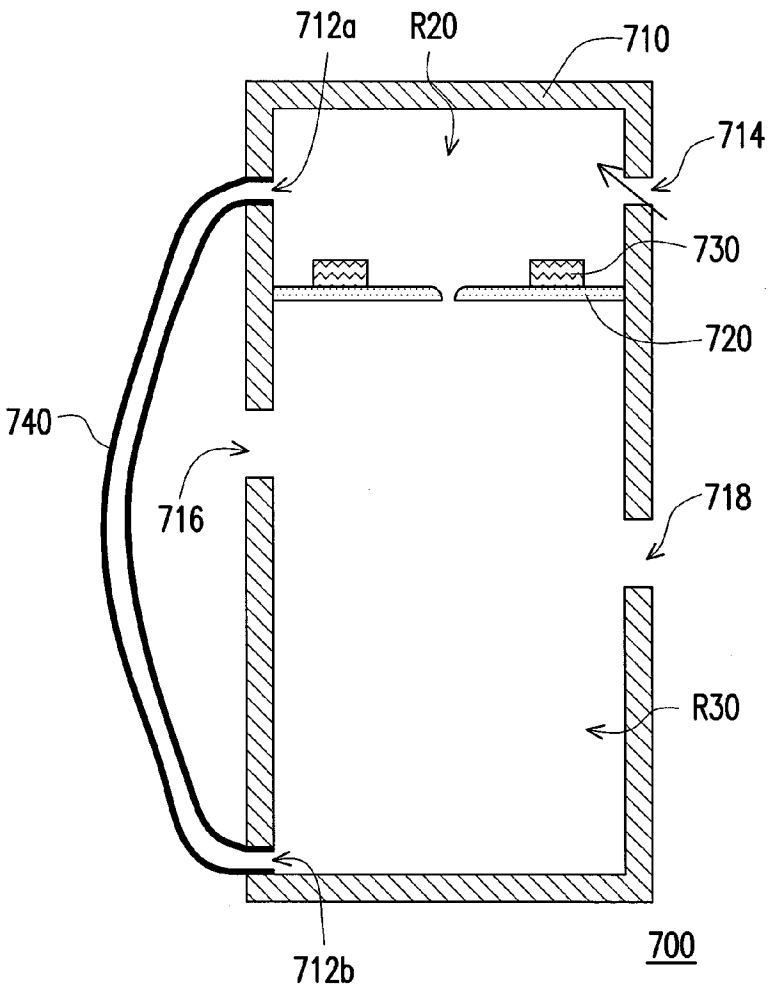
FIG. 7 is a schematic sectional view of the micro-pump according to another embodiment.
Figure 8B:
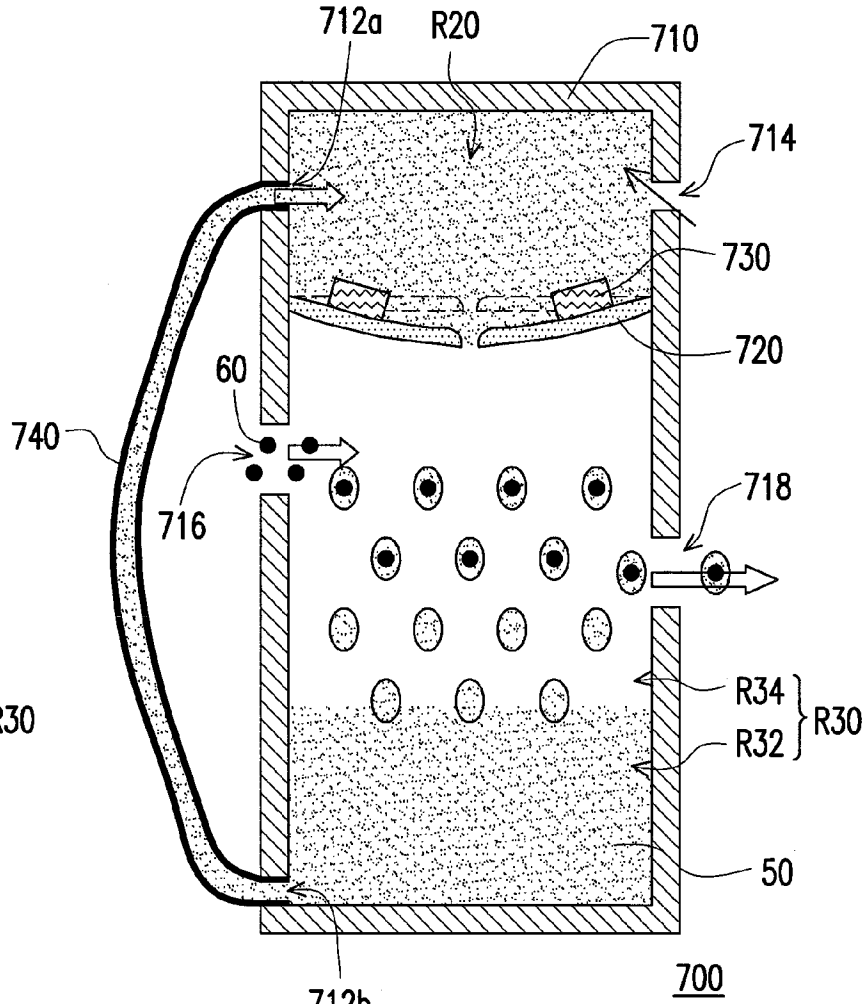
FIG. 8B is a schematic sectional view of the micro-pump in FIG. 7 when complementing liquid.
Figure 8A:
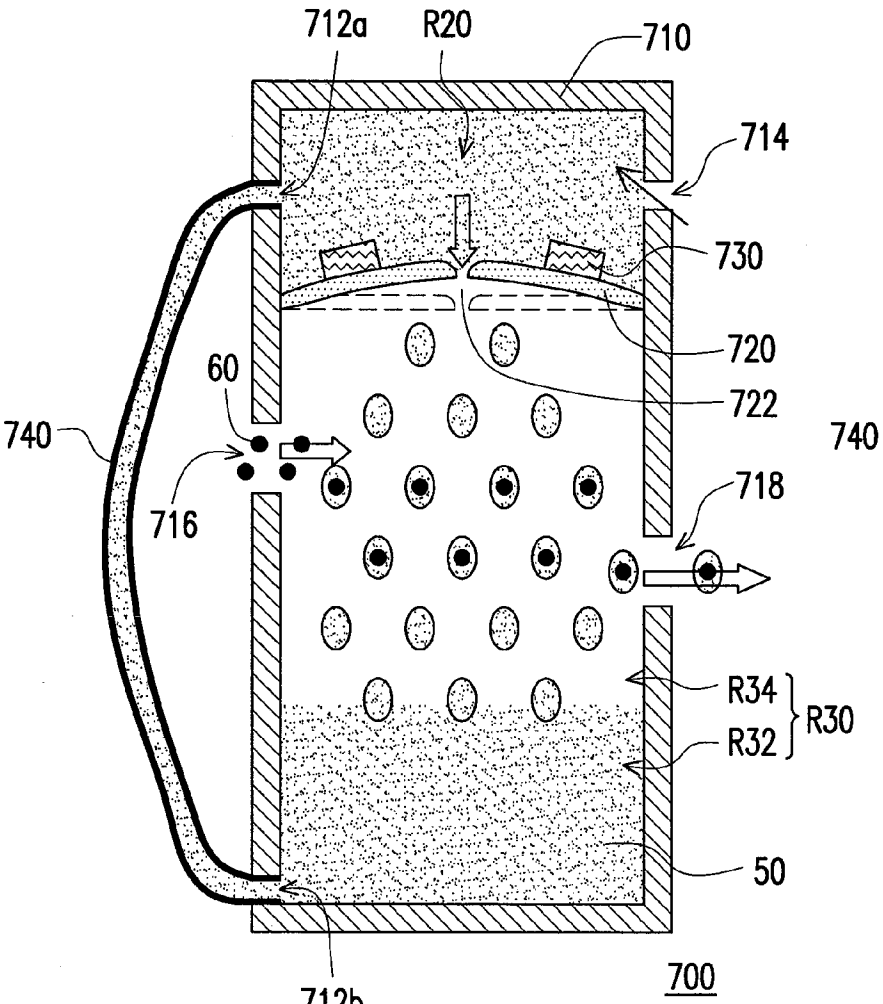
FIG. 8A is a schematic sectional view of the micro-pump in FIG. 7 when atomizing liquid.

FIG. 7 is a schematic sectional view of the micro-pump according to another embodiment. FIG. 8A is a schematic sectional view of the micro-pump in FIG. 7 when atomizing liquid. FIG. 8B is a schematic sectional view of the micro-pump in FIG. 7 when complementing liquid.

Referring to FIG. 7, a micro-pump 700 of the present embodiment, similar to the micro-pump 100 in FIG. 1, comprises a main-housing 710, a nozzle plate 720, and an actuator 730. The micro-pump 700 further comprises a liquid transport pipe 740. The main-housing 710 has a liquid inlet 712*a*, a liquid outlet 712*b*, a one-way exhaust structure 714, an air inlet 716, and a micro-droplet outlet 718. The nozzle plate 720 divides the interior of the main-housing 710 into a first chamber R20 and a second chamber R30, wherein the function of the first chamber R20 is the same as that of the first chamber R10 in FIG. 1.

Next, referring to FIG. 8A, the second chamber R30 is used to contain the liquid 50 and can be divided into a liquid region R32 and an air region R34. The liquid 50 is contained in the liquid region R32. The air inlet 716 of the main-housing 710 and the micro-droplet outlet 718 are connected with the air region R34 of the second chamber R30. The liquid inlet 712*a* of the main-housing 710 and the liquid outlet 712*b* are respectively connected with the first chamber R20 and the liquid region R32 of the second chamber R30. The liquid transport pipe 740 connects the liquid inlet 712*a* and the liquid outlet 712*b*.

When the micro-pump 700 of the present embodiment operates, if the nozzle plate 720 is deformed toward the interior of the first chamber R20 under the drive of the actuator 730, the liquid 50 is pressed and sprayed into the air region R34 through a nozzle 722, as shown in FIG. 8A. The sprayed micro-droplets are exhausted through the micro-droplet outlet 718 for other uses, and the portion of the un-exhausted micro-droplets falls into the liquid region R32. Thus, the micro-pump 700 can recycle the liquid 50. On the contrary, if the nozzle plate 720 is deformed toward the exterior of the first chamber R20 under the drive of the actuator 730, the nozzle 722 is blocked under the capillary force of the liquid 50. Thus, the liquid in the first chamber R20 is reduced and the first chamber R20 assumes the negative pressure. As a result, the liquid 50 is sucked from the liquid region R32 through the liquid outlet 712*b*, the liquid transport pipe 740, and the liquid inlet 712*a* into the first chamber R20, as shown in FIG. 8B.

Further, the micro-pump 700 of the present embodiment can also be used in the pharmaceutical field. For example, if the liquid 50 is a medicine containing a certain ingredient and is used to uniformly cover a solid medicine 60 containing another ingredient, the medicine 60 can be made into powder and sent into the air region R34 through the air inlet 716. Meanwhile, the micro-pump 700 atomizes the liquid 50 and sprays the micro-droplets into the air region R34. Thus, the atomized liquid 50 covers the powder medicine 60 in the air region R34 and the composed medicine is discharged through the micro-droplet outlet 718. As the micro-pump 700 of the present embodiment does not apply a high pressure to the liquid 50, the property of the liquid 50 does not change even if the liquid 50 is a sensitive medicine. Moreover, the liquid 50 not composed with the medicine 60 can be recycled, thereby significantly reducing the cost of medicine production.

Figure 9:
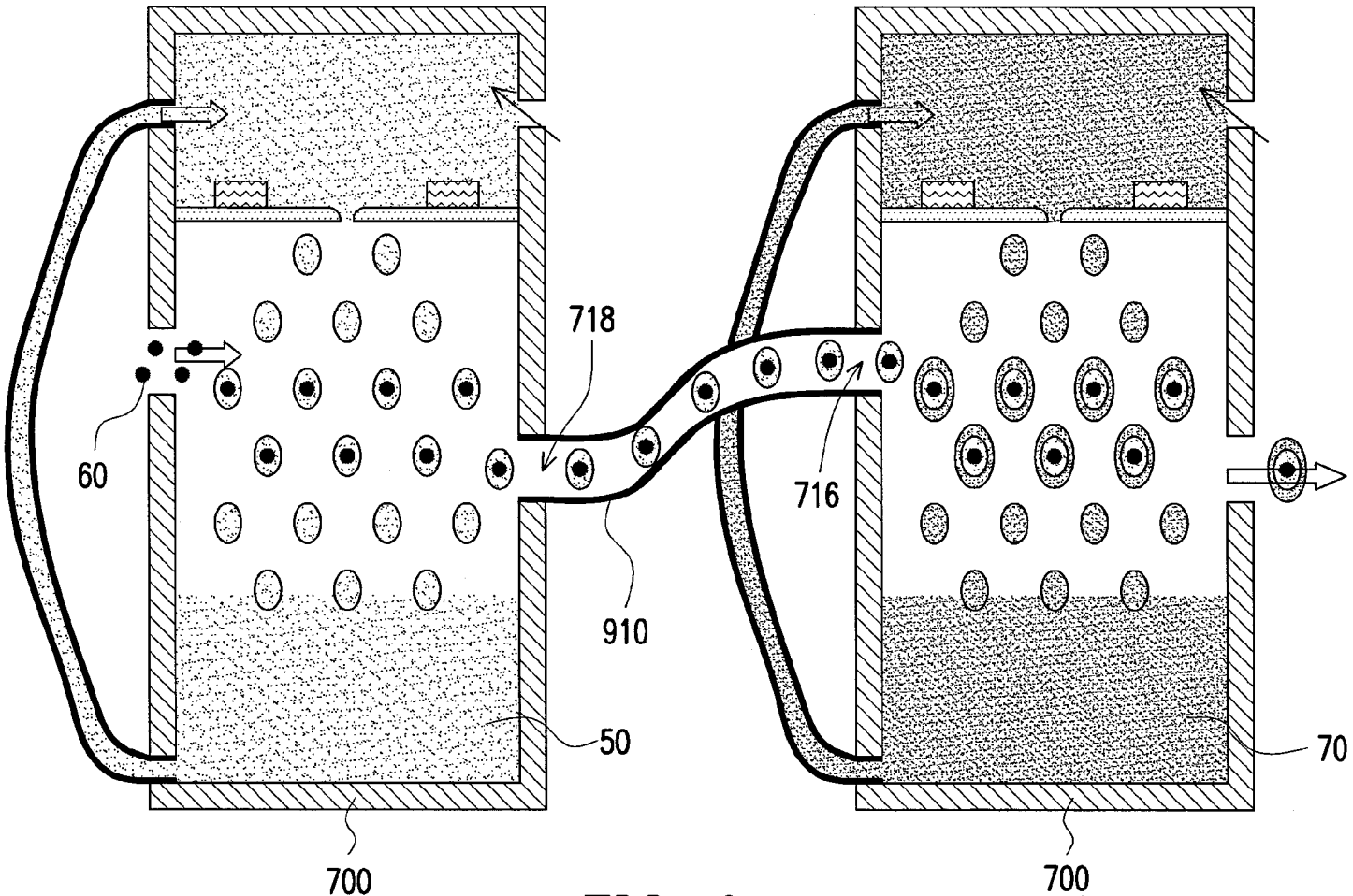
FIG. 9 is a schematic sectional view of the micro-pump system according to an embodiment.

FIG. 9 is a schematic sectional view of the micro-pump system according to an embodiment. Referring to FIG. 9, a micro-pump system 900 of the present embodiment comprises a plurality of micro-pumps 700 as in FIG. 7 and at least one micro-droplet transport pipe 910. The two ends of the micro-droplet transport pipe 910 are respectively connected to the air inlet 716 of a micro-pump 700 and the micro-droplet outlet 718 of another micro-pump 700. In the micro-pump system 900 to of the present embodiment, after being atomized by the first micro-pump 700, the liquid 50 is transported through the path of the micro-droplet outlet 718, the micro-droplet transport pipe 910, and the air inlet 716 into the next micro-pump 700 and is composed with the atomized liquid 70 in the next micro-pump 700. Accordingly, in the micro-pump system 900 of the present embodiment, more micro-pumps 700 can be joined, so as to atomize and compose more liquids of different kinds.

Likewise, the micro-pump 900 of the present embodiment can also be used in the pharmaceutical field. For example, after being composed with the atomized liquid 50, the powdered medicine 60 is transported to the next micro-pump 700 and is composed with the atomized liquid 70. As such, a single system can be used to produce a medicine composed of various ingredients.

In view of the above, the micro-pump and micro-pump system can be used to transport micro-fluid under normal pressure and atomize liquid without requiring a high pressure. The micro-droplets can not only be used in cooling, thus improving the heat dissipation efficiency, but also used in the surface treatment or film coating, and the like. Moreover, the micro-droplets can be used in the pharmaceutical field to enhance the effect of medicine and reduce the cost of medicine. Meanwhile, the micro-pump and micro-pump system have various advantages, such as low power consumption, simple components, and small volume.

Though the present invention has been disclosed above by the disclosed embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A micro-pump, for atomizing a liquid, comprising:

a main-housing, having a liquid inlet, a liquid outlet, an air inlet, and a micro-droplet outlet;

a nozzle plate, assembled to the main-housing, having at least one nozzle and dividing an interior of the main-housing into a first chamber and a second chamber, wherein the at least one nozzle and the liquid inlet are connected with the first chamber, and the air inlet, the liquid outlet, and the micro-droplet outlet are connected with the second chamber;

at least one actuator, disposed on at least one of the main-housing or the nozzle plate, wherein the at least one actuator drives the nozzle plate, so that the liquid is filled into the first chamber and sprayed out through the at least one nozzle into the second chamber; and a liquid transport pipe, connecting the liquid inlet and the liquid outlet.

2. The micro-pump according to claim 1, wherein the at least one actuator drives the nozzle plate with a resonant region frequency.

3. The micro-pump according to claim 1, wherein the main-housing further has a one-way exhaust structure to exhaust air from the first chamber and allow the liquid to fill the first chamber.

4. The micro-pump according to claim 1, wherein the at least one actuator comprises a piezoelectric element or an electrostrictive element for driving the nozzle plate, so as to generate a sufficient momentum to spray the liquid out of the at least one nozzle.

5. The micro-pump according to claim 1, wherein the at least one actuator is in the form of a rectangular sheet, a round sheet, or a ring sheet.

6. The micro-pump according to claim 1, wherein the at least one nozzle is a tapered hole for transporting the liquid in a single direction.

7. The micro-pump according to claim 1, wherein the nozzle plate comprises:

a nozzle layer, having the at least one nozzle and a trench, wherein the at least one nozzle penetrates the at least one nozzle layer, the trench is disposed on a surface of the at least one nozzle layer surrounding the at least one nozzle and is spaced apart from the nozzle by a distance.

8. The micro-pump according to claim 7, wherein the nozzle plate further comprises a filling material filling the trench, a wetting angle of a surface of the filling material is different from that of the surface of the nozzle layer.

9. The micro-pump according to claim 1, wherein the nozzle plate comprises:

a nozzle layer, having the at least one nozzle and a plurality of trenches, wherein the at least one nozzle penetrates the at least one nozzle layer, the plurality of trenches are disposed on a surface of the at least one nozzle layer surrounding the nozzle and are spaced apart from the nozzle by a distance.

10. The micro-pump according to claim 9, wherein the nozzle plate further comprises a plurality of filling materials filling the plurality of trenches, wetting angles of surfaces of the filling materials are different from that of the surface of the nozzle layer.

11. The micro-pump according to claim 9, wherein the nozzle layer further has at least one connecting trench for connecting the plurality of trenches.

12. A micro-pump system, comprising:

a plurality of micro-pumps, for atomizing a liquid, each of the plurality of micro-pumps comprising:

a main-housing, having a liquid inlet, a liquid outlet, an air inlet, and a micro-droplet outlet;

a nozzle plate, assembled to the main-housing, having at least one nozzle and dividing an interior of the main-housing into a first chamber and a second chamber, wherein the at least one nozzle and the liquid inlet are connected with the first chamber, and the air inlet, the liquid outlet, and the micro-droplet outlet are connected with the second chamber;

at least one actuator, disposed on at least one of the main-housing or the nozzle plate, wherein the at least one actuator drives the nozzle plate, so that the liquid is filled into the first chamber and sprayed out through the at least one nozzle into the second chamber; and a liquid transport pipe, connecting the liquid inlet and the liquid outlet; and at least one micro-droplet transport pipe, with two ends respectively connected to the air inlet of one of the micro-pumps and the micro-droplet outlet of another one of the plurality of micro-pumps.

13. The micro-pump system according to claim 12, wherein in each of the plurality of micro-pumps, the at least one actuator drives the nozzle plate with a resonant region frequency.

14. The micro-pump system according to claim 12, wherein in each of the plurality of micro-pumps, the main-housing further has a one-way exhaust structure to exhaust air from the first chamber and allow the liquid to fill the first chamber.

15. The micro-pump system according to claim 12, wherein in each of the plurality of micro-pumps, the at least one actuator comprises a piezoelectric element or an electrostrictive element for driving the nozzle plate, so as to generate a sufficient momentum to spray the liquid out of the at least one nozzle.

16. The micro-pump system according to claim 12, wherein in each of the plurality of micro-pumps, the at least one actuator is in the form of a rectangular sheet, a round sheet, or a ring sheet.

17. The micro-pump system according to claim 12, wherein in each of the plurality of micro-pumps, the at least one nozzle is a tapered hole for transporting the liquid in a single direction.

18. The micro-pump system according to claim 12, wherein in each of the plurality of micro-pumps, the nozzle plate comprises:

a nozzle layer, having the at least one nozzle and a trench, wherein the nozzle penetrates the at least one nozzle layer, the trench is disposed on a surface of the at least one nozzle layer surrounding the at least one nozzle and is spaced away from the nozzle by a distance.

19. The micro-pump system according to claim 18, wherein in each of the plurality of micro-pumps, the nozzle plate comprises a filling material filling the trench, a wetting angle of a surface of the filling material is different from that of the surface of the nozzle layer.

20. The micro-pump system according to claim 12, wherein in each of the plurality of micro-pumps, the nozzle plate comprises:

a nozzle layer, having the at least one nozzle and a plurality of trenches, wherein the at least one nozzle penetrates the nozzle layer, the plurality of trenches are disposed on a surface of the nozzle layer surrounding the at least one nozzle and are spaced apart from the at least one nozzle for a distance.

21. The micro-pump system according to claim 20, wherein in each of the plurality of micro-pumps, the nozzle plate comprises a plurality of filling materials filling the plurality of trenches, wetting angles of surfaces of the plurality of filling materials are different from that of the surface of the nozzle layer.

22. The micro-pump system according to claim 20, wherein in each of the plurality of micro-pumps, the nozzle layer further has at least one connecting trench for connecting the plurality of trenches.

* * * * *